US009709372B2

(12) United States Patent
Edwards

(10) Patent No.: US 9,709,372 B2
(45) Date of Patent: Jul. 18, 2017

(54) SEMI-ACTIVE RF TARGET DETECTION AND PROXIMITY DETONATION BASED ON ANGLE-TO-TARGET

(71) Applicant: Raytheon Company, Waltham, MA (US)

(72) Inventor: Jeffrey C. Edwards, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 131 days.

(21) Appl. No.: 14/623,886

(22) Filed: Feb. 17, 2015

(65) Prior Publication Data

US 2016/0305755 A1 Oct. 20, 2016

(51) Int. Cl.

| | |
|---|---|
| ***F42C 13/04*** | (2006.01) |
| ***F41G 7/30*** | (2006.01) |
| ***F42B 12/20*** | (2006.01) |

(52) U.S. Cl.

CPC ..... *F42C 13/04* (2013.01); *F41G 7/30* (2013.01); *F42B 12/20* (2013.01); *F42C 13/045* (2013.01)

(58) Field of Classification Search

CPC ..... F42C 13/04; F42C 13/042; F42C 13/045; F42C 13/047; F42B 30/006; F42B 15/01; F41G 7/2266; F41G 7/2286; F41G 7/2293; F41G 7/28; F41G 7/30

USPC ..... 102/214; 244/3.14, 3.19

See application file for complete search history.

(56) References Cited

U.S. PATENT DOCUMENTS

| | | | | |
|---|---|---|---|---|
| 3,113,305 | A | 12/1963 | Trounson et al. | |
| 3,152,547 | A | 10/1964 | Kyle | |
| 3,875,569 | A | 4/1975 | Hill et al. | |
| 4,589,610 | A * | 5/1986 | Schmidt | F41G 7/22 244/3.19 |
| 4,991,508 | A | 2/1991 | Ziemba | |
| 5,530,447 | A * | 6/1996 | Henderson | G01S 13/931 340/904 |
| 5,613,650 | A * | 3/1997 | Kaifu | F42C 13/04 102/211 |
| 8,076,621 | B2 * | 12/2011 | Rastegar | F41G 7/305 244/3.1 |
| 8,698,058 | B1 * | 4/2014 | LaPat | F41G 7/008 244/3.1 |
| 2005/0253017 | A1 * | 11/2005 | Kongelbeck | F41G 7/2266 244/3.1 |
| 2010/0067608 | A1 * | 3/2010 | Tyree | F41G 7/2246 375/285 |
| 2012/0169524 | A1 * | 7/2012 | Yeary | G01S 5/0273 342/62 |
| 2014/0266868 | A1 * | 9/2014 | Schuman | G01S 13/9029 342/25 B |

* cited by examiner

*Primary Examiner* — Bret Hayes

(74) *Attorney, Agent, or Firm* — Eric A. Gifford

(57) ABSTRACT

A semi-active RF proximity fuze for warhead detonation is provided where external RADAR is available to illuminate the target. The fuze incorporates multiple receiving antennas with digital phase detection processing to distinguish the angle from which the target returns are received and uses that information to determine the detonation timing for the warhead. Detonation timing can be improved by processing the rate of change of the angle-to-target or processing the range and Doppler information to compensate for target velocity and distance.

20 Claims, 6 Drawing Sheets

SEMI-ACTIVE RF TARGET DETECTION AND PROXIMITY DETONATION BASED ON ANGLE-TO-TARGET

BACKGROUND OF THE INVENTION

Field of the Invention

This invention relates to RF controlled proximity fuzes for projectiles.

Description of the Related Art

A proximity fuze is a fuze that detonates an explosive device automatically when the distance to the target becomes smaller than a predetermined value. British Army researchers Sir Samuel Curran and W. A. S. Butement developed a proximity fuze in the early stages of World War II under the name "VT", an acronym of "Variable Time fuze". The system was a small, short range, Doppler radar. Proximity fuzes may be incorporated into a projectile, which includes self-propelled missiles, rockets and gun-launched munitions. Proximity fuzes are designed for targets such as planes, missiles, ships at sea and ground forces. They provide a more sophisticated trigger mechanism than the common contact fuze or timed fuze.

U.S. Pat. No. 3,113,305 entitled "Semi-Active Proximity Fuze" uses a remote source of electromagnetic radiation to illuminate a target. The missile includes a single antenna with rear and front lobes to receive radiation directly from the source and to receive reflections from the target. The missile uses an analog receiver to mix the signals to detect the amplitude of the Doppler beat frequency. A firing circuit detonates the missile when the amplitude peaks.

U.S. Pat. No. 3,152,547 entitled "Radio Proximity Fuze" uses a shell that contains a micro-transmitter that uses the shell body as an antenna and emits a continuous wave of roughly 180-220 MHz. As the shell approaches a reflecting object, an interference pattern is created. This pattern changes with shrinking distance: every half wavelength in distance (a half wavelength at this frequency is about 0.7 meters), the transmitter is in or out of resonance. This causes a small oscillation of the radiated power and consequently the oscillator supply current of about 200-800 Hz, the Doppler frequency. This signal is sent through a band pass filter, amplified, and triggers the detonation when it exceeds a given amplitude.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides a semi-active RF proximity fuze for warhead detonation where external RADAR is available to illuminate the target.

This is accomplished by using multiple receiving antennas with digital phase detection processing to distinguish the angle from Which the target returns are received and use that information to determine the detonation timing for the warhead. In different embodiments, detonation timing can be improved by processing the rate of change of the angle-to-target, and processing the range and Doppler information to compensate for target velocity and distance.

In an embodiment of the proximity fuze, a plurality of RF antenna have at least one rear-facing lobe configured to receive pulsed radiation directly from an RF source and at least three forward-facing lobes configured to receive reflections of the pulsed radiation from the target. A multi-channel receiver is coupled to the plurality of RF antenna. Each channel is configured to receive and condition the RF signal to feed an A/D converter to produce a sequence of digital samples. A digital signal processor is configured to process a phase relationship between the digital samples from the three or more forward-facing lobes and the rear-facing lobe to generate a sequence of angle-to-target estimates and to process the angle-to-target estimates to issue a detonation command to detonate the explosive warhead.

In an embodiment, the digital signal processor is configured to process the sequence of angle-to-target estimates to generate an angle-to-target rate and to issue the detonation command when the angle-to-target rate reaches and then decreases from a peak value.

In an embodiment, the digital signal processor is configured to issue the detonation command when the angle-to-target estimate reaches a certain angle. The processor may be configured to compute the angle-to-target rate and use that rate to predict when the angle-to-target estimate will reach the certain angle. The certain angle may be fixed apriori for a particular projectile and missile or the processor may be configured to generate range-to-target and relative velocity estimates to set the certain angle.

In an embodiment, each channel of the multi-channel receiver comprises gain control configured to keep the amplitude of the received RF signal within a linear range of the A/D converter and a filter configured to pass an RF signal frequency at a down converted intermediate frequency plus an expected Doppler shift. The processor may comprise a plurality of match filters that correlate the digital samples from the rear-facing lobe to the digital samples from each of the forward-facing lobes to extract the phrase relationship to estimate the angle-to-target.

These and other features and advantages of the invention will be apparent to those skilled in the art from the following detailed description of preferred embodiments, taken together with the accompanying drawings, in which:

DETAILED DESCRIPTION OF THE INVENTION

The present invention provides a semi-active RF proximity fuze for warhead detonation where external RADAR is available to illuminate the target. This is accomplished by using multiple receiving antennas with digital phase detection processing to distinguish the angle from which the target returns are received and use that information to determine the detonation timing for the warhead. In different embodiments, detonation timing can be improved by processing the rate of change of the angle-to-target, and processing the range and Doppler information to compensate for target velocity and distance.

The semi-active RF proximity fuze can be incorporated into a wide range of projectiles to perform various missions against different targets. The fuze may be used with self-propelled missiles or rockets or gun-launched munitions. The projectiles may be spinning or spin-stabilized. They may be used against targets such as planes, missiles, ships at sea and ground forces.

Figure 1:
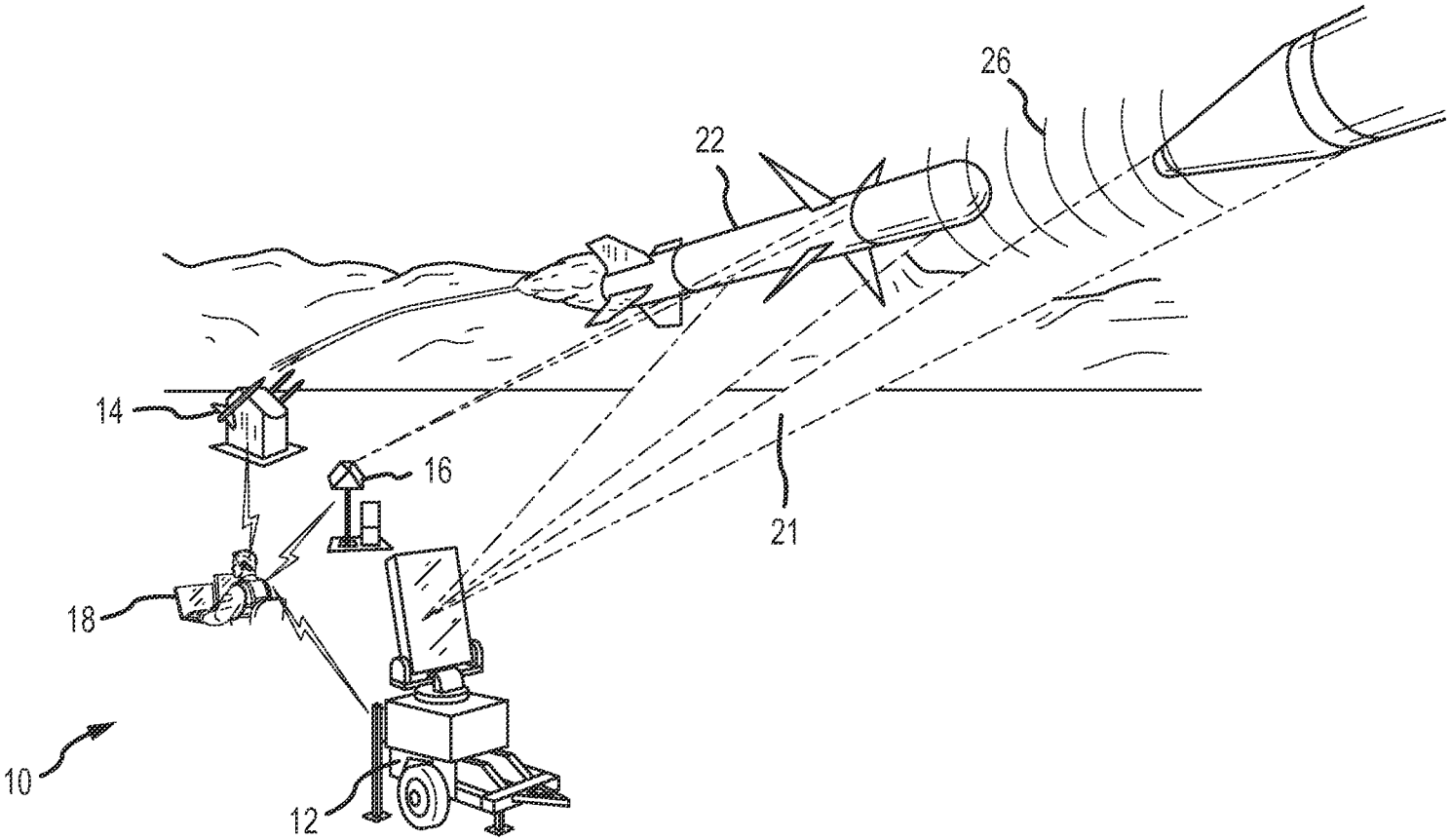
FIG. 1 is a diagram of a semi-active system for target detection and detonation based on between the angle rate between the projectile and target.

Referring now to FIG. 1, an embodiment of a missile defense system 10 includes a ground illumination radar 12, a projectile battery 14 a data uplink 16 and a portable command station 18. The ground illumination radar 12 illuminates a target 20 with pulsed RF radiation 21 to detect, acquire and track the target 20. Command station 18 issues a command to battery 14 to launch a projectile 22 to engage target 20. Command station 18 receives tracking updates from radar 12 and transmits commands via data link 16 to command guide the projectile 22 towards the target.

At some point in flight, projectile 22 is in position to receive both the pulsed RF radiation 21 directly from radar 12 and reflections 26 of the pulsed RF radiation from target 20 at three or more locations. Using the directed pulsed radiation as a reference, the projectile exploits the phase relationship between the reflections received at the three or more locations to generate a sequence of angle-to-target estimates where the angle-to-target is measured off of the direction of motion of the projectile. The projectile processes the angle-to-target estimates to issue a detonation command to detonate the explosive warhead in proximity to the target.

Figure 2A:
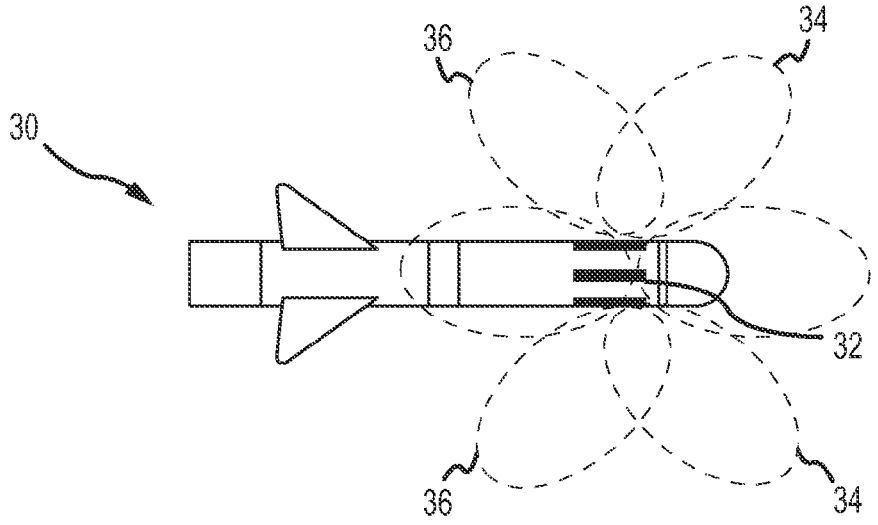
FIGS. 2*a* and 2*b* are diagrams of different antenna configurations that provide at least one rear-facing lobe adapted to received pulsed radiation directly from an RF source and at least three forward-facing lobes adapted to receive reflections of the pulsed radiation from the target.
Figure 2B:
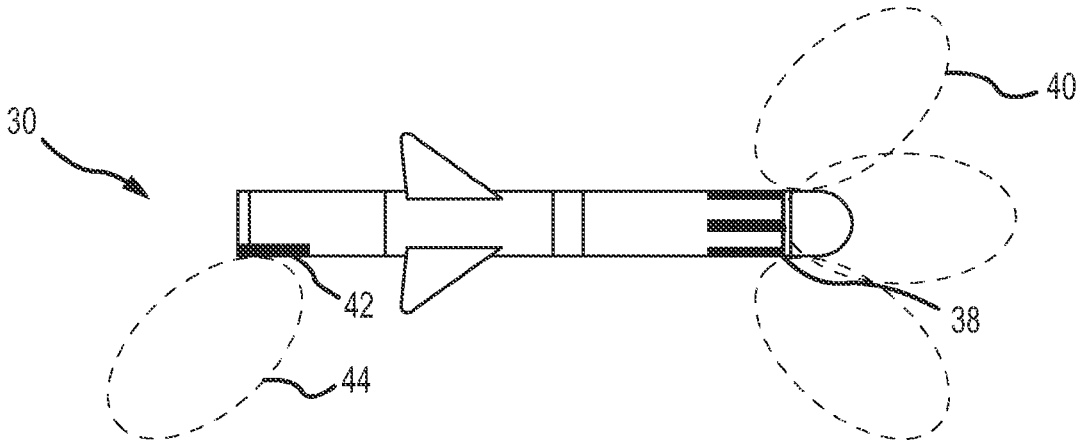

Referring now to FIGS. 2*a* and 2*b*, each projectile 30 includes a plurality of RF antenna having at least one rear-facing lobe configured to receive pulsed radiation directly from an RF source and at least three forward-facing lobes configured to receive reflections of said pulsed radiation from the target. As shown in FIG. 2*a*, each RF antenna 32 is configured with forward and rear antenna lobes 34 and 36, respectively. As shown in FIG. 2*b*, each of the three forward positioned antenna 38 is configured with a forward antenna lobe 40 and the aft position antenna 42 is configured with a rear antenna lobe 44.

Figure 3A:
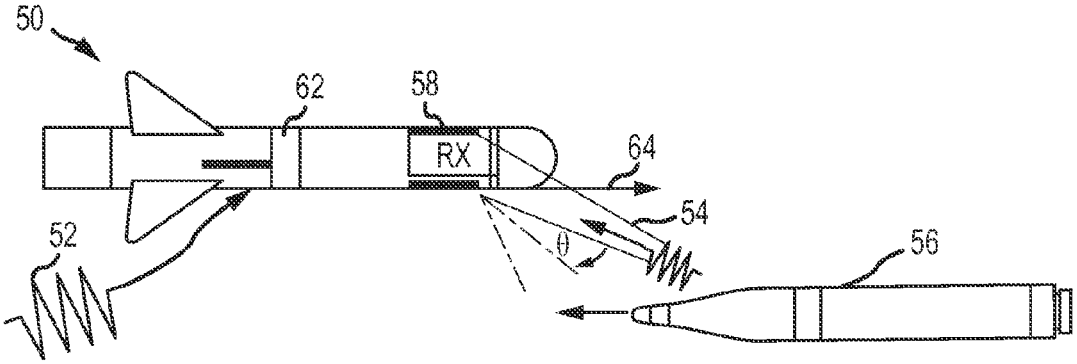
FIGS. 3*a* and 3*b* are diagrams illustrating target angle sensing and warhead detonation timing based on target angle and rate of change.
Figure 3B:
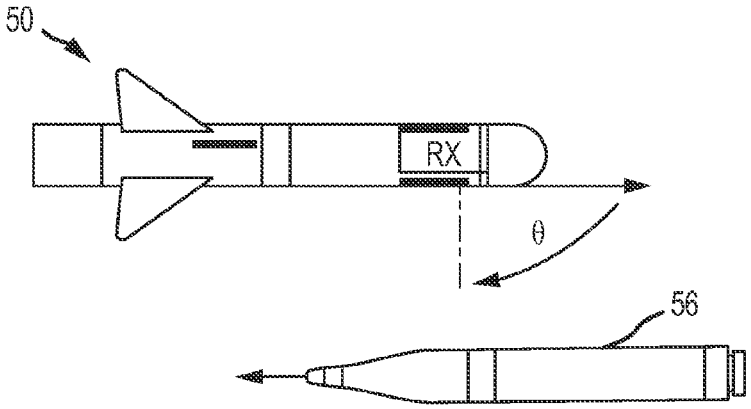

Referring now to FIGS. 3*a* and 3*b*, a projectile 50 while in flight receives pulsed radiation 52 directly from an RF source and receives reflections 54 of the pulsed radiation from a target 56 at at least three different locations on the projectile. Each channel of a multi-channel receiver (Rx) 58 is configured to receive and condition the RF signal to feed an A/D converter to produce a sequence of digital samples. The direct pulsed radiation 52 provides a reference. The reflections 54 have differing phase due to the varying distances to the target 56. A digital signal processor is configured to extract and process a phase relationship between the digital samples from the three or more forward-facing lobes and the rear-facing lobe to generate a sequence of angle-to-target estimates Θ and to process the angle-to-target estimates Θ to issue a detonation command to detonate an explosive warhead 62. Θ is the angle formed between the projectile's direction of motion 64 and the line of sight from the projectile to the target.

In an embodiment, the digital signal processor is configured to issue the detonation command when the angle-to-target estimate Θ reaches a certain angle. The certain angle may be fixed a priori based on characteristics of the projectile and/or the expected target. The processor may be configured to process the sequence of angle-to-target estimates Θ to generate an angle-to-target rate dΘ/dt and use that rate to predict when the angle-to-target estimate Θ will reach the certain angle to improve the detonation timing accuracy.

In an embodiment, the digital signal processor is configured to process the sequence of angle-to-target estimates Θ to generate an angle-to-target rate dΘ/dt and to issue the detonation command when the angle-to-target rate reaches and then decreases from a peak value. This is similar to the conventional RF proximity fuze that issues the detonation command at the peak of the amplitude of the Doppler beat frequency. Triggering off of the peak of the angle-to-target rate is preferable to Doppler because with digital processing, phase relationships are easier to calculate and the multiple antenna returns reduce noise effects.

Figure 4A:
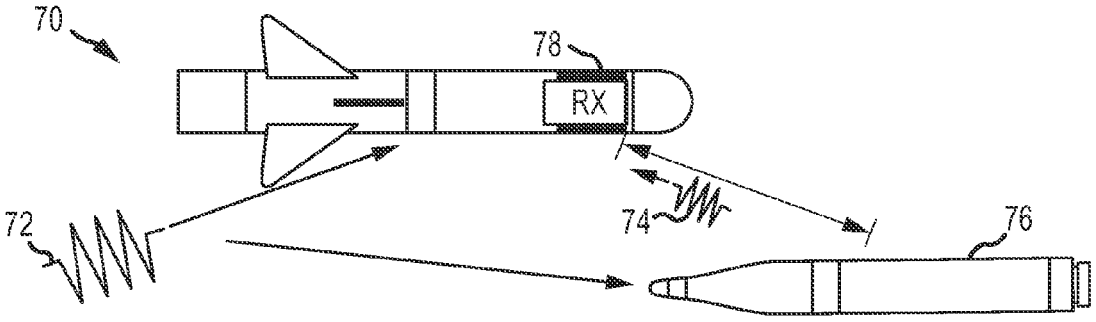
FIGS. 4*a* and 4*b* are diagrams illustrating target range and velocity sensing and warhead detonation timing based on angle, range and closing velocity.
Figure 4B:
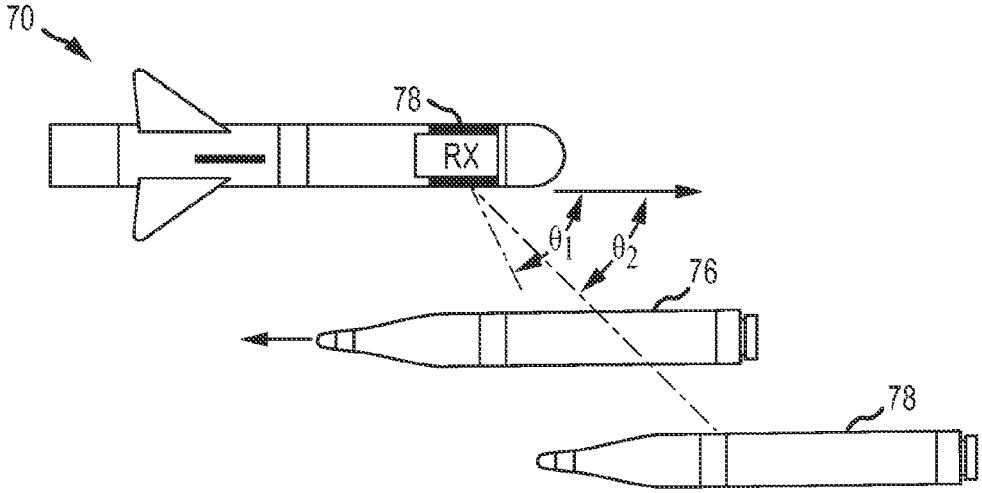

Referring now to FIGS. 4*a* and 4*b*, projectile 70 while in flight receives pulsed radiation 72 directly from an RF source and receives reflections 74 of the pulsed radiation from a target 76 at at least three different locations (antenna) on the projectile. In addition to processing the sequences of digital samples to generate angle-to-target estimates Θ and possibly angle-to-target rate estimates dΘ/dt, a multi-channel receiver 78 is configured to process the digital samples to generate a range-to-target estimate and a relative velocity (Doppler) estimate and to process the range-to-target and relative velocity estimates to set a certain angle that when reached triggers the issuance of the detonation command. The range and relative velocity estimates may be computed from a single forward (and rear) channel or from all of the available forward (and rear) channels to reduce noise. For example, if the relative velocity is slow or the range-to-target is small, the optimum angle $\Theta_1$ for detonation may be large, near the 90-degree angle corresponding to the peak in the angle-to-target rate. If the relative velocity is high or the range-to-target is large, the optimum angle $\Theta_2$ for detonation may be small, less than the 90-degree angle, so that the explosive blast of the warhead intercepts the target. In certain situations based on properties of the projectile or target, the certain angle may be computed to lag, greater than 90-degrees. For example, in a long projectile the warhead may be placed several feet behind the forward antennas necessitating a slight delay in detonation for optimal effect. Alternately, for certain hard targets it may be important to control detonation timing for maximum effect at a particular aimpoint on the target. The receiver may also compute the angle-to-target rate dΘ/dt and use that rate to predict when the angle-to-target estimate will reach the certain angle set by the range and/or relative velocity.

Figure 5:
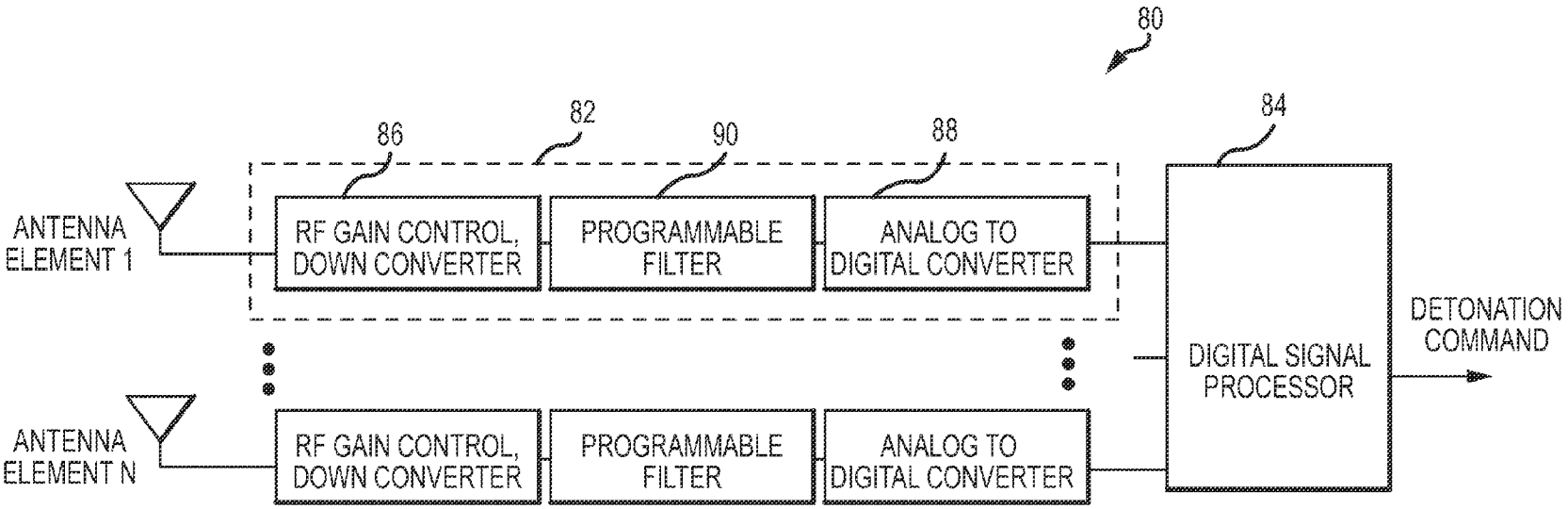
FIG. 5 is a block diagram of an embodiment of a multi-channel digital receiver configured to process the returns from the plurality of antenna.

Referring now to FIG. 5, an embodiment of a multi-channel receiver 80 comprises N identical processing channels 82 each connected to a different antenna (at least one rear facing antenna and at least three forward facing antenna) that together feed digital samples to a digital signal processor 84. Each channel includes RF gain control and down conversion 86 that keep the amplitude of the received RF signal within a linear range of an A/D converter 88 and down converts from the RF frequency band (e.g. X band at 10 GHz) to an intermediate frequency (IF) near 10 MHz. A programmable filter 90 is configured to pass an RF signal frequency at the IF frequency plus an expected Doppler shift. The A/D convert 88 converts the IF analog signal to a sequence of digital samples. Digital signal processor 84 processes the sequences of digital samples from the various rear and forward channels to compute the angle-to-target, angle-to-target rate, range-to-target and relative velocity estimates and processes those estimates to issue the detonation command.

In an alternate embodiment, the multi-channel receiver may have a single physical channel that is time multiplexed between the N antennas.

Figure 6:
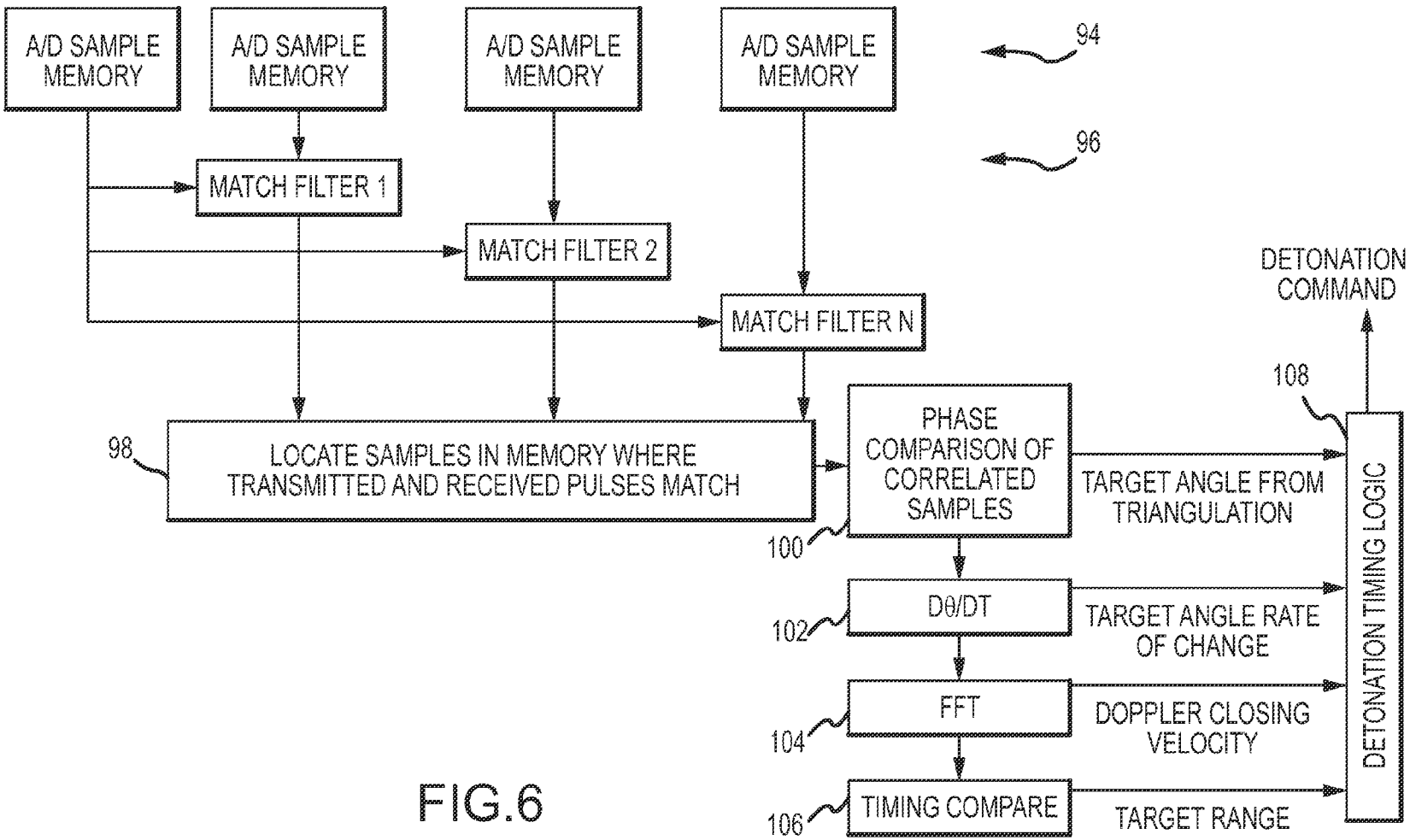
FIG. 6 is a block diagram of an embodiment for digital signal processing of the multi-channel returns to initiate detonation.

Referring now to FIG. 6, an embodiment of digital signal processor 84 comprises A/D sample memory 94 in the signal processor to receive and store digital samples from the rear and each of the forward antennas. Match filters 96 correlate the digital samples of each forward facing antenna to the samples from the rear facing antenna. The output 98 of the match filters matches the samples of the original RF source to the delayed samples of RF energy reflected back from the target.

Once the RF source samples and target reflections from the various antennas are matched, further processing identifies the spatial and temporal relationship between the target and projectile. A phase comparison 100 allows triangulation of the target to projectile angle to produce the angle-to-target $\Theta$. The rate that the angle changes over time $d\Theta/dt$ is calculated for angle rate 102. An FFT 104 identifies the frequency difference between the source and reflected signals to calculate the closing velocity from the Doppler shift. Finally, a timing comparison between the arrival times of the source and reflection is used to calculate the range-to-target 106. Detonation timing logic 108 uses the calculated projectile to target relationships to choose the appropriate time for detonation based on the measured parameters 108.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. An apparatus, comprising:

a projectile adapted to pass in proximity to a target, said projectile including a plurality of RF antennae having at least one rear-facing lobe configured to receive pulsed radiation directly from an RF source and at least three forward-facing lobes configured to receive reflections of said pulsed radiation from the target;

an explosive warhead; and a multi-channel receiver comprising a plurality of processing channels coupled to said plurality of RF antennae that together feed digital samples of received pulsed radiation to a digital signal processor, said digital signal processor comprising sample memory to receive and store digital samples from the at least one rear-facing lobe and each of said forward-facing lobes, at least three match filters to correlate the digital samples of each of said at least three forward-facing lobes to the digital samples from the at least one rear-facing lobe to match the digital samples of the RF source to the samples of reflections of said pulsed radiation from the target, a phase comparator to compare a phase relationship between the matched digital samples from the at least three forward-facing lobes and the at least one rear-facing lobe to generate via triangulation a sequence of angle-to-target estimates and detonation timing logic to process the angle-to-target estimates to issue a detonation command to detonate the explosive warhead.

2. The apparatus of claim 1, wherein the digital signal processor is configured to process the sequence of angle-to-target estimates to generate an angle-to-target rate and to issue the detonation command when the angle-to-target rate reaches and then decreases from a peak value.

3. The apparatus of claim 1, wherein the digital signal processor is configured to issue the detonation command when the angle-to-target estimate reaches a certain angle, wherein the digital signal processor is configurable to set the certain angle.

4. The apparatus of claim 3, wherein the certain angle is fixed and the digital signal processor set apriori based on characteristics of the projectile or the target.

5. The apparatus of claim 4, wherein the digital signal processor is configured to process the sequence of angle-to-target estimates to generate an angle-to-target rate and to use that rate to predict when the angle-to-target estimate will reach the certain angle.

6. The apparatus of claim 3, wherein the digital signal processor is configured to process the sequence of digital samples from at least one of the forward-facing lobes and the at least one rear-facing lobe to generate a range-to-target estimate and a relative velocity estimate and to process the range-to-target and relative velocity estimates to set the certain angle.

7. The apparatus of claim 6, wherein the digital signal processor is configured to process the sequence of angle-to-target estimates to generate an angle-to-target rate and to use that rate to predict when the angle-to-target estimate will reach the certain angle.

8. The apparatus of claim 1, wherein the projectile comprises a rear-facing antenna and at least three forward-facing antennae.

9. The apparatus of claim 1, wherein each channel of the multi-channel receiver comprises gain control configured to keep an amplitude of the received RF signal within a linear range of the A/D converter and a filter configured to pass an RF signal frequency at a source frequency of the RF source plus an expected Doppler shift.

10. The projectile of claim 1, wherein the digital signal processor comprises a plurality of match filters that correlate the digital samples from the at least one rear-facing lobe to the digital samples from each of the at least three forward-facing lobes to extract the phase relationship.

11. A proximity fuze for a projectile, comprising:

a plurality of RF antennae having at least one rear-facing lobe configured to receive pulsed radiation directly from an RF source and at least three forward-facing lobes configured to receive reflections of said pulsed radiation from the target; and a multi-channel receiver comprising a plurality of processing channels coupled to said plurality of RF antennae that together feed digital samples of received pulsed radiation to a digital signal processor, said digital signal processor comprising sample memory to receive and store digital samples from the at least one rear-facing lobe and each of said forward-facing lobes, at least three match filters to correlate the digital samples of each of said at least three forward-facing lobes to the digital samples from the at least one rear-facing lobe to match the digital samples of the RF source to the samples of reflections of said pulsed radiation from the target, a phase comparator to compare a phase relationship between the matched digital samples from the at least three forward-facing lobes and the at least one rear-facing lobe to generate via triangulation a sequence of angle-to-target estimates and detonation timing logic to process the angle-to-target estimates to issue a detonation command to detonate the explosive warhead.

12. The proximity fuze of claim 11, wherein the digital signal processor is configured to process the sequence of angle-to-target estimates to generate an angle-to-target rate and to issue the detonation command when the angle-to-target rate reaches and then decreases from a peak value.

13. The proximity fuze of claim 11, wherein the digital signal processor is configured to issue the detonation command when the angle-to-target estimate reaches a certain angle, wherein the digital signal processor is configurable to set the certain angle.

14. The projectile of claim 13, wherein the digital signal processor is configured to process the sequence of digital samples from at least one of the forward-facing lobes and the at least one rear-facing lobe to generate a range-to-target estimate and a relative velocity estimate and to process the range-to-target and relative velocity estimates to set the certain angle.

15. The projectile of claim 14, wherein the digital signal processor is configured to process the sequence of angle-to-target estimates to generate an angle-to-target rate and to use that rate to predict when the angle-to-target estimate will reach the certain angle.

16. A method of proximity detonation of a projectile, comprising:

receiving and conditioning an RF signal at each of at least one rear-facing lobe configured to receive pulsed radiation directly from an RF source and at least three forward-facing lobes configured to receive reflections of said pulsed radiation from a target;

converting the RF signal to a sequence of digital samples;

correlating the digital samples of each of said at least three forward-facing lobes to the digital samples from the at least one rear-facing lobe to match the digital samples of the RF source to the samples of reflections of said pulsed radiation from the target;

comparing a phase relationship between the matched digital samples from the at least three forward-facing lobes and the at least one rear-facing lobe to generate via triangulation a sequence of angle-to-target estimates; and processing the angle-to-target estimates to issue a detonation command to detonate the explosive warhead.

17. The method of claim 16, further comprising processing the sequence of angle-to-target estimates to generate an angle-to-target rate and issuing the detonation command when the angle-to-target rate reaches and then decreases from a peak value.

18. The method of claim 16, wherein the detonation command is issued when the angle-to-target estimate reaches a certain angle, further comprising setting the certain angle either a priori based on characteristics of the projectile or the target or in-flight.

19. The method of claim 18, further comprising processing the sequence of digital samples from at least one of the forward-facing lobes and the at least one rear-facing lobe to generate a range-to-target estimate and a relative velocity estimate and processing the range-to-target and relative velocity estimates to set the certain angle.

20. The method of claim 19, further comprising processing the sequence of angle-to-target estimates to generate an angle-to-target rate and using that rate to predict when the angle-to-target estimate will reach the certain angle.

* * * * *